United States Patent [19]

Church

[11] 4,370,096

[45] Jan. 25, 1983

[54] MARINE PROPELLER

[75] Inventor: Leslie G. Church, Auckland, New Zealand

[73] Assignee: Propeller Design Limited, Manurewa, New Zealand

[21] Appl. No.: 70,868

[22] Filed: Aug. 29, 1979

[30] Foreign Application Priority Data

Aug. 30, 1978 [NZ] New Zealand ..... 188298

[51] Int. Cl.[3] ..... B63H 1/16

[52] U.S. Cl. ..... 416/189; 416/237

[58] Field of Search ..... 416/189 R, 237, 189 RA

[56] References Cited

U.S. PATENT DOCUMENTS

| | | | |
|---|---|---|---|
| Re. 16,001 | 2/1925 | Gill | 416/189 R |
| 406,708 | 7/1889 | Daniels | 416/189 R |
| 677,101 | 6/1901 | Parker | 416/189 R |
| 745,871 | 12/1903 | MacDuff | 416/189 R |
| 1,467,515 | 9/1923 | Stewart | 416/189 R |
| 1,518,501 | 12/1924 | Gill | 416/189 R |
| 1,635,840 | 7/1927 | Haw | 416/208 |
| 1,968,955 | 8/1934 | Mobley | 416/189 R |
| 2,426,742 | 9/1947 | Pawlowski | 416/189 R |
| 2,438,867 | 3/1948 | Rockwell et al. | 416/189 R X |
| 3,124,097 | 3/1964 | Priddle | 416/189 R |
| 3,246,698 | 4/1966 | Kiekhaefer | 416/189 R X |
| 3,487,805 | 1/1970 | Satterthwaite et al. | 416/189 R X |
| 3,519,367 | 7/1970 | Soulez-Lariviere | 416/189 R X |

FOREIGN PATENT DOCUMENTS

| | | | |
|---|---|---|---|
| 2606448 | 8/1977 | Fed. Rep. of Germany | 416/189 R |
| 498391 | 1/1920 | France | 416/189 R |
| 526521 | 3/1920 | France . | |
| 223296 | 10/1924 | United Kingdom . | |
| 267774 | 3/1927 | United Kingdom . | |
| 344478 | 3/1931 | United Kingdom . | |
| 540841 | 10/1941 | United Kingdom . | |
| 574293 | 12/1945 | United Kingdom . | |
| 991744 | 6/1961 | United Kingdom . | |
| 992266 | 4/1962 | United Kingdom . | |
| 1324356 | 12/1970 | United Kingdom . | |

*Primary Examiner*—Everette A. Powell, Jr.

*Attorney, Agent, or Firm*—Stevens, Davis, Miller & Mosher

[57] ABSTRACT

A marine ring propeller comprising blades, each having parallel edges and a constant cross-section, and a ring in the form of an annular shroud fixed to the outer ends of the blades. The shroud is typically frusto-conical on its inner surface and curved on its outer surface to provide an aerofoil cross-section, apart from the leading edge which is provided with a concave bevel on either or both of the inner and outer surfaces.

18 Claims, 7 Drawing Figures

MARINE PROPELLER

BACKGROUND OF THE INVENTION

This invention relates to a marine propeller.

In the past propellers have suffered from a loss of efficiency towards the outer edges of the propeller blades where water tends to be flung outwardly from the blades as a result of centrifugal action. The rotational energy of the blade is thus partly dissipated in driving water in a direction other than parallel to the central axis of the propeller.

The object of the present invention is to go some way towards overcoming the above disadvantage.

Various ring propellers have been attempted earlier, but none of these have been very successful. Examples may be seen in British Patent Specification Nos. 203/1879 (Fisher), 15045/1890 (Jensen), 453/1893 (Rateau), 16750/1912 (Allen), 147705 (de Coninck), 192908 (Seay), 780910 (Taylor & Shipp) and 1324356 (lips N.V.). In none of these do the propeller blades have parallel edges and a constant cross-section along their length, which is a major distinguishing feature of the present invention and which enables the propeller of the present invention to operate more efficiently than any of those mentioned. British Patent Specification 2000477A (General Motors Corporation) shows a ring fan with parallel edges on it on its blades, but the blades do not extend as far as the ring, and the shape of the ring as well as the manner in which the ring is attached to the blades render it quite unsuitable for use as a marine propeller.

SUMMARY OF THE INVENTION

Accordingly, the present invention consists in a marine ring propeller comprising a plurality of propeller blades positioned around a central hub, each blade having parallel edges and a cross-section which is constant along the length of the blade, and a shroud comprising an annular wall fixed directly to the outer ends of the blades.

BRIEF DESCRIPTION OF THE DRAWINGS

The above gives a broad description of the present invention, a few preferred forms of which will now be described with reference to the accompanying drawings in which.

DESCRIPTION OF THE PREFERRED EMBODIMENT

Figure 2:
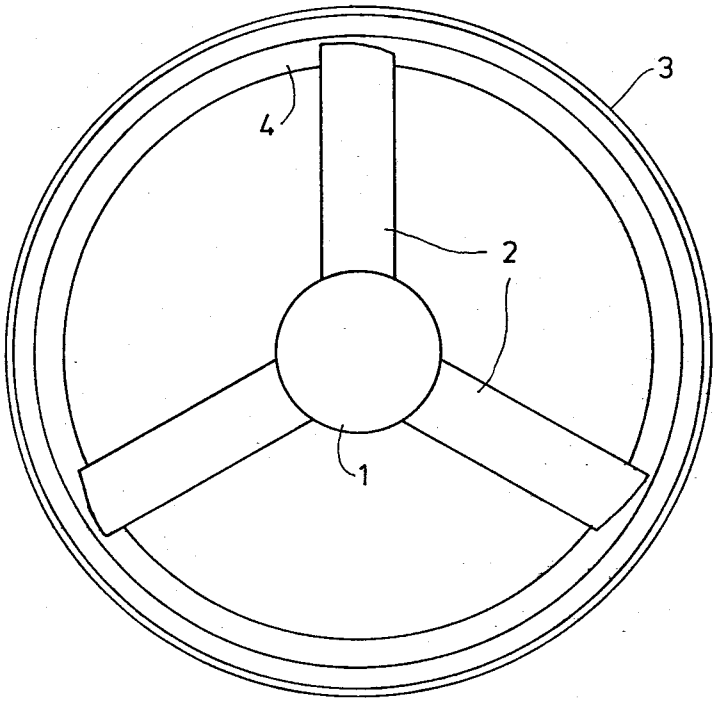
FIG. 2 is a front view of the propeller shown in FIG. 1.
Figure 1:
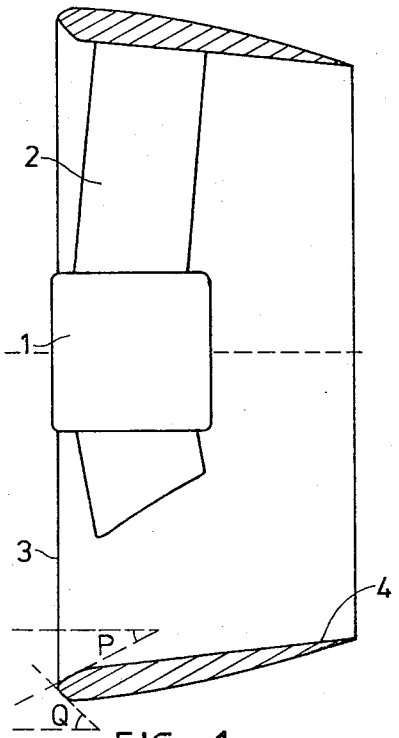
FIG. 1 is a sectional view of a propeller of the present invention.
Figure 5:
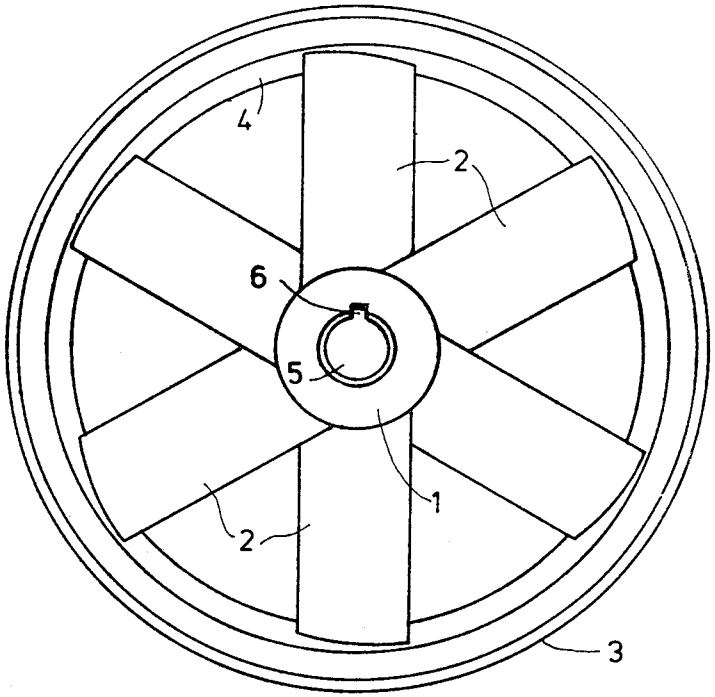
FIG. 5 is a front view of the propeller shown in FIG. 4.
Figure 4:
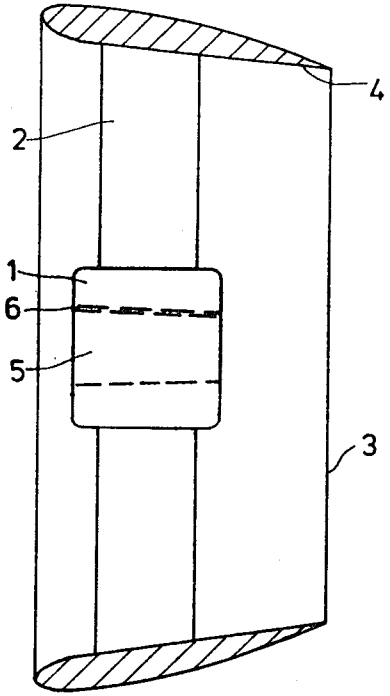
FIG. 4 is a sectional view of a second propeller according to the present invention.
Figure 7:
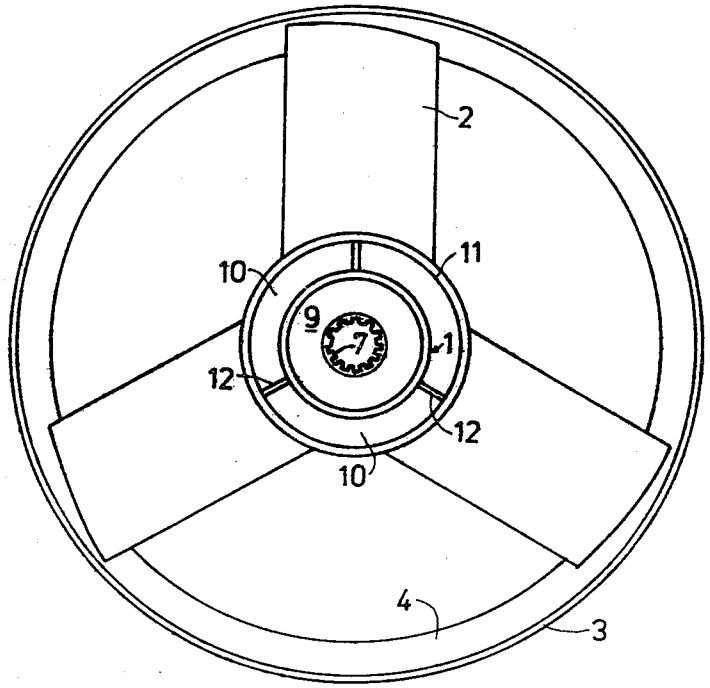
FIG. 7 is a front view of the propeller shown in FIG. 6.
Figure 6:
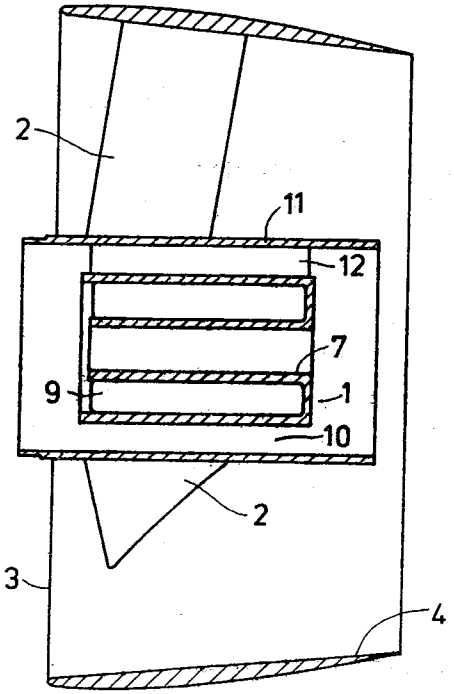
FIG. 6 is a sectional view of a third propeller according to the present invention.

FIGS. 1 and 2 show a propeller suitable for use with a high speed water craft, FIGS. 4 and 5 show a general purpose propeller, and FIGS. 6 and 7 show a propeller particularly suitable for use on outboard engines and inboard-inboard-outboard marine drives. These propellers are not, however, restricted to use for the purposes indicated.

The preferred propeller according to the present invention comprises a central hub 1 to which two to twelve blades 2 are fixed. The number of blades need not be restricted to this range, although it is expected that most propellers will have between three and six blades. For special purposes propellers with numbers of blades beyond this range can be used and will still fall within the scope of the present invention.

At the outer ends of the blades there is a shroud 3, concentric with the hub 1, and with a hydrodynamic cross-section, preferably in the shape of an aerofoil, the thick end of the aerofoil being at the wider end of the shroud. The inner surface 4 of the wall of the shroud is frusto-conical, not having an arcuate cross-section, and is preferably angled at 6 degrees from the central axis of the propeller, although it could be anywhere between 0 and 18 degrees. The usual range is between 5 and 10 degrees.

The leading edge of the shroud is preferably bevelled on both its inner and outer surfaces. The inner bevel is typically at an angle of 15° to 45° from the central axis of the propeller (angle P in FIG. 1) while the outer bevel is typically at an angle of 5° to 35° from the central axis (angle Q). These bevels are shaped for hydrodynamic flow, to assist in retaining laminar flow disturbance. The bevels are preferably slightly concave.

Figure 3:
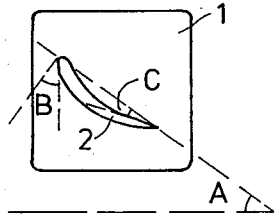
FIG. 3 is a cross sectional view of the blade, also showing its relationship with the hub.

The chord of the blades 2, represented by angle A in FIG. 3, is set anywhere between 20 and 80 degrees, preferably between 30 and 68 degrees. The number of blades and their pitch may be selected according to the particular use to which the propeller is to be put. A typical propeller may have six blades with a blade pitch of 50 degrees. The propellers can be either left or right-handed, and can, if desired, be produced in handed pairs. The blades all have a common chord root, which is to say that they have parallel edges and their cross-section is constant along their length. The longitudinal axis of each blade may be perpendicular to the central axis of the propeller, or it may vary from an angle 10 degrees forward of the perpendicular plane to 20 degrees back from it, although the preferred range is between 5 degrees forward and a 10 degree lay back. For many applications the blades will have a 7 degree lay back. Blade angles outside of this range are still within the scope of this invention, however.

A propeller for high speed craft may typically have only three blades, the longitudinal axes of which are set back 5 degrees from a plane perpendicular to the central axis of the propeller. Such a propeller is shown in FIGS. 1 and 2.

The propeller may be of any desired diameter from a few centimeters to several meters. The dimension will of course depend upon the particular application to which the propeller is being put.

The length of the shroud will vary with the diameter of course, the ratio of the diameter to the shroud length being for most propellers approximately $2\frac{1}{2}$, although the ratio may vary considerably from this for special applications. For example, a typical propeller 236 mm in diameter may have a shroud length of 100 mm, whereas a typical propeller 8 m in diameter may have a shroud length of 3 m.

The ratio of the shroud length to the blade width, both measurements being taken in a direction parallel to the central axis of the propeller, may typically vary between 1:1 and 5:1 although for most application this ratio, known as the blade group, will be about 2.5:1.

The drawings show the blades positioned generally forwardly within the shroud. There is no particular need for the blades to be so positioned, however, and in some applications, particularly where silent operation of the propeller is desirable, it may be advantageous to set the blades towards the aft of the shroud.

As shown in FIG. 3, the leading edge of each blade typically has a bevel, the plane of the bevel preferably being 0 to 35 degrees back from the plane normal to the plane of the blade, as shown by angle B in the drawing. At the trailing edge of the blade the underside is typically also at an angle C between 0 and 35 degrees from the plane of the blade.

The central bore of the hub may be arranged in any of several different ways. For example, the bore may be cylindrical, the hub being provided with a pin which extends transversely through the bore to secure the hub to a drive shaft.

FIGS. 4 and 5 illustrate a tapered bore 5 with a keyway 6, such as has commonly been used for securing prior art propellers to their shafts.

FIGS. 7 and 8 illustrate a splined bore 7. In this particular version the bore is also shown with a flexible rubber bushing 9 and an annular exhaust passage 10, the hub being secured to an outer sleeve 11 by means of radial fins 12. However, the rubber bushing and/or exhaust passage need not be provided, if preferred, and they can if desired be used with an ordinary cylindrical or tapered bore as described above.

The propeller of the present invention may also have the following possible advantages over a conventional screw propeller:

It wastes less energy and therefore requires less engine power to give the same forward thrust;

The covering of the blades by the shroud means that the blades are much less likely to tangle with and cause damage to lines such as divers, trawler gear, water skiers lines and the like, which means that the propeller is safer.

It is less prone to fouling and to structural damage because of the protection to the blades afforded by the shroud; and The tapering of the shroud gives the propeller better braking characteristics. At present the stopping distance of a large oil tanker is about ten miles. It is expected that the present invention will reduce this distance significantly.

Also, because the outer surface of the propeller comprises a smooth shroud rather than a series of propeller tips threshing through the water, the water immediately around the propeller is not subject to turbulence. The propeller produces a neutral torque, so that it does not matter if all of the propellers of a large ship rotate in the same direction. It also means that no helm correction is required as the neutral torque of the propeller means that the propeller does not tend to swing the stern around in the manner that conventional screw propellers do. It also means that the noise produced by the propeller is greatly reduced. This may be of particular advantage for some fishing boats where it is necessary not to frighten the fish, and also in some military applications.

The reduced turbulance of the present invention means that foaming at the surface is minimized, even when the propeller is operating at high speeds near the surface. Also the wake formed by the propeller as the ship is travelling forwards is much smaller.

Furthermore, the propeller is not greatly affected by pooping. If a ship is travelling through a following sea and a wave picks the stern of the ship up out of the water, it does not tend to swing the ship around in the manner that conventional screen propellers do since as long as the propeller is at least partly submerged, it will continue to pick water up so that propulsion is maintained and the ship is not subjected to pooping. As the bottom portion of the propeller passes through the water the blades tend to throw water up within the confines of the shroud and then propel it rearwardly so that the ship continues to be propelled forwardly. This effect also means that the propeller can be fitted much closer to the surface of the water than is possible for conventional propellers, particularly in large ships.

The blade is also much less subject to oscillation because of the steadying nature of the shroud so that the blade oscillation clearance normally required in a ship is no longer necessary. The propeller of the present invention can be fitted much closer to the hull than can a conventional screw.

It has been found in trials of the present invention that thrust operates at a much lower rate of revolution than is possible than conventional screws. This means that a boat or ship will be much easier to hold steady, especially in rough conditions. It has also been found that the propeller is not greatly affected by dead wood immediately in front of the propeller as the blades within the shroud tend to draw water into the tube formed by the shroud as long as it has reasonable access.

The propeller of the present invention can be used in any type of situation where ordinary screws are currently used, and is particularly useful for steering propellers and for bow and stern thrust applications. It can be used for outboards, stern drives, tug and towing vessels, icebreakers, and all types of surface and underwater craft, etc.

Many variations to the particular propellers described above are possible within the scope of the present invention as broadly claimed, although some such variations may be less preferred. For example, many variations to the cross-sectional shape of the annular wall are possible. It may, for instance, be curved either inwardly or outwardly, or both in a complex curve. The blades may have cross-sections which are not strictly aerofoil-shaped, or they may be curved or angled relative to the radial direction of the propeller.

What we claim is:

1. A marine ring propeller comprising:

a plurality of elongated propeller blades positioned around a central hub, each blade having leading and trailing edges which are straight and parallel to each other, each blade being smoothly curved concavo-convex in cross-section with the leading edges being beveled to be substantially parallel to the plane of rotation of the propeller; the cross-section of each blade being constant along the length of the blade;

a shroud shaped as an annular wall fixed to the outer ends of the blades and having an inner surface and outer surface, the inner surface being frusto-conical so as to be converging toward the downstream end of the propeller at an angle between 1° and 15° to the rotational axis; said inner surface being substantially flat from the trailing edge of the annular wall forward to a point axially forward of the point of contact with the leading edge of the propeller blade; said outer surface being essentially of smoothly curved convex shape when viewed in cross-section.

2. The propeller of claim 1 wherein the longitudinal axis of each blade is positioned along a radius of the shroud.

3. The propeller of claim 1 in which the taper of the inner surface of the shroud is substantially 6 degrees from the central axis.

4. The propeller of claim 1 wherein the blades are at an angle of 20 to 80 degrees to the axis of rotation.

5. The propeller of claim 4 wherein the blade angle is between 30 and 68 degrees.

6. The propeller of claim 1 wherein the longitudinal axis of each blade is angled between 10 degrees forward and 20 degrees rearward of the plane perpendicular to the central axis of the propeller.

7. The propeller of claim 6 wherein the longitudinal axis of each blade is angled between 5 degrees forward and 10 degrees rearwardly of the plane perpendicular to the central axis of the propeller.

8. The propeller of claim 7 wherein the longitudinal axis of each blade is angled at approximately 7 degrees rearward of the plane perpendicular to the central axis of the propeller.

9. The propeller of claim 1 wherein the number of blades is between two and twelve.

10. The propeller of claim 1 wherein the number of blades is between three and six.

11. The propeller of claim 1 wherein the trailing edge of each blade has an under surface which meets the plane passing through and leading and trailing edges of the blade at an angle between 0 and 35 degrees.

12. The propeller of claim 1 wherein the leading edge of the inner surface of the shroud is beveled at a point forward of said flat area.

13. The propeller of claim 12 wherein the bevel at the leading edge of the inner surface of the shroud is at an angle of 15° to 45° from the central axis of the propeller.

14. The propeller of claim 1 wherein the leading edge of the outer surface of the shroud is beveled.

15. The propeller of claim 14 wherein the bevel at the leading edge of the outer surface of the shroud is at an angle of 5° to 35° from the central axis of the propeller.

16. The propeller of claim 12 or 14 wherein at least one of the bevels at the leading edge of the shroud is slightly concave.

17. The propeller of claim 1 wherein the ratio of the shroud length to the blade width, as measured in a direction parallel to the central axis of the propeller, is between 1:1 and 5:1.

18. The propeller of claim 17 wherein the said ratio is approximately 2.5:1.

* * * * *